US012378047B2

(12) United States Patent
De Cleir

(10) Patent No.: US 12,378,047 B2
(45) Date of Patent: Aug. 5, 2025

(54) VENTABLE PACKAGE FOR FOOD AND BEVERAGES

(71) Applicant: The Coca-Cola Company, Atlanta, GA (US)

(72) Inventor: Piaras De Cleir, Marietta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 115 days.

(21) Appl. No.: 17/996,096

(22) PCT Filed: Apr. 15, 2021

(86) PCT No.: PCT/US2021/027475

§ 371 (c)(1),
(2) Date: Oct. 13, 2022

(87) PCT Pub. No.: WO2021/211837

PCT Pub. Date: Oct. 21, 2021

(65) Prior Publication Data

US 2023/0192370 A1 Jun. 22, 2023

Related U.S. Application Data

(60) Provisional application No. 63/011,618, filed on Apr. 17, 2020.

(51) Int. Cl.

| | |
|---|---|
| ***B65D 51/16*** | (2006.01) |
| ***B65D 77/30*** | (2006.01) |
| *B65D 77/22* | (2006.01) |

(52) U.S. Cl.
CPC ..... *B65D 51/1638* (2013.01); *B65D 77/30* (2013.01); *B65D 2205/02* (2013.01); *B65D 2251/20* (2013.01)

(58) Field of Classification Search
CPC ..... B65D 1/02; B65D 1/0207; B65D 1/0215; B65D 1/0223; B65D 1/023; B65D 1/0246;
(Continued)

(56) References Cited

U.S. PATENT DOCUMENTS 3,061,139 A 10/1962 Edwards
4,387,551 A * 6/1983 Cowan ..... B29C 65/76 156/69

(Continued)

FOREIGN PATENT DOCUMENTS

AT 11 738 U1 4/2011
CA 696686 A 10/1964

(Continued)

OTHER PUBLICATIONS

Article: Easy Open Film for Boil and Retort Difaren E3700T, E3800T—Google Translate (Year: 201), Author: DIC Corporation, URL: pp. 77-78, URL: https://www.dic-global.com/pdf/r_and_d/review/dic_r_and_d_2001.pdf, URL Last Check: Apr. 2, 2024.*

(Continued)

*Primary Examiner* — Anthony D Stashick
*Assistant Examiner* — Marcos Javier Rodriguez Molina
(74) *Attorney, Agent, or Firm* — Eversheds Sutherland (US) LLP

(57) ABSTRACT

The present application provides a ventable package capable of releasing pressure upon the application of heat or internal pressure. The ventable package may include a container and a lid. The lid may include a sealing layer attached to the container and a foil layer attached to the sealing layer. The sealing layer may include one or more slits therein such that, upon the application of heat or internal pressure, the foil layer separates from the sealing layer about the one or more slits to release the pressure therein.

20 Claims, 3 Drawing Sheets

(58) Field of Classification Search

CPC .. B65D 1/0261; B65D 1/0276; B65D 1/0284; B65D 1/0292; B65D 1/20; B65D 1/225; B65D 1/243; B65D 1/265; B65D 1/326; B65D 1/38; B65D 1/40; B65D 1/42; B65D 1/44; B65D 1/46; B65D 1/48; B65D 11/02; B65D 11/04; B65D 11/06; B65D 11/20; B65D 17/28; B65D 17/36; B65D 17/4012; B65D 17/4014; B65D 17/502; B65D 19/0018; B65D 19/0026; B65D 19/0028; B65D 19/0036; B65D 19/004; B65D 19/38; B65D 21/0204; B65D 21/0231; B65D 21/0233; B65D 21/0238; B65D 21/068; B65D 2203/00; B65D 2203/02; B65D 2203/10; B65D 2205/00; B65D 2205/02; B65D 2231/002; B65D 2231/004; B65D 2231/02; B65D 2251/0018; B65D 2251/0025; B65D 2251/0071; B65D 2251/0087; B65D 2251/023; B65D 2251/1041; B65D 2251/1075; B65D 2251/20; B65D 23/00; B65D 23/02; B65D 23/0814; B65D 23/0821; B65D 23/0828; B65D 23/0878; B65D 23/10; B65D 23/102; B65D 23/104; B65D 23/106; B65D 23/108; B65D 23/14; B65D 2401/30; B65D 2401/35; B65D 25/00; B65D 25/04; B65D 25/14; B65D 25/2835; B65D 25/30; B65D 25/44; B65D 25/465; B65D 2501/0018; B65D 2501/0027; B65D 2501/0036; B65D 2501/0045; B65D 2501/0081; B65D 2501/009; B65D 2501/24019; B65D 2501/2407; B65D 2501/24082; B65D 2501/24133; B65D 2501/2414; B65D 2501/24146; B65D 2501/24216; B65D 2501/24235; B65D 2501/24261; B65D 2501/24286; B65D 2501/24324; B65D 2501/2435; B65D 2501/24522; B65D 2501/24541; B65D 2501/24566; B65D 2501/24598; B65D 2517/0014; B65D 2517/0016; B65D 2517/0041; B65D 2517/0049; B65D 2517/0052; B65D 2517/0053; B65D 2517/0062; B65D 2517/0089; B65D 2517/0098; B65D 2517/5016; B65D 2517/5032; B65D 2517/5083; B65D 2519/00019; B65D 2519/00034; B65D 2519/00044; B65D 2519/00069; B65D 2519/00104; B65D 2519/00268; B65D 2519/00273; B65D 2519/00288; B65D 2519/00296; B65D 2519/00308; B65D 2519/00318; B65D 2519/00323; B65D 2519/00333; B65D 2519/00338; B65D 2519/00363; B65D 2519/00373; B65D 2519/00407; B65D 2519/00412; B65D 2519/00557; B65D 2519/00562; B65D 2519/00567; B65D 2519/00572; B65D 2519/00771; B65D 2519/00786; B65D 2519/00791; B65D 2519/00796; B65D 2519/008; B65D 2519/0094; B65D 2519/0096; B65D 2543/00037; B65D 2543/00092; B65D 2543/00231; B65D 2543/00277; B65D 2543/00296; B65D 2543/00314; B65D 2543/00351; B65D 2543/0049; B65D 2543/00509; B65D 2543/00518; B65D 2543/00537; B65D 2543/00546; B65D 2543/00555; B65D 2543/0062; B65D 2543/00629; B65D 2543/00685; B65D 2543/00694; B65D 2543/0074; B65D 2543/00768; B65D 2543/00796; B65D 2543/00805; B65D 2543/00851; B65D 2543/00925; B65D 2571/0003; B65D 2571/00037; B65D 2571/00055; B65D 2571/00117; B65D 2571/00141; B65D 2571/00216; B65D 2571/0029; B65D 2571/00302; B65D 2571/00339; B65D 2571/0037; B65D 2571/00401; B65D 2571/00444; B65D 2571/0045; B65D 2571/00487; B65D 2571/00493; B65D 2571/00549; B65D 2571/00561; B65D 2571/00574; B65D 2571/0058; B65D 2571/00586; B65D 2571/00623; B65D 2571/0066; B65D 2571/00666; B65D 2571/00679; B65D 2571/00716; B65D 2571/00728; B65D 2571/00753; B65D 2571/0079; B65D 2571/00839; B65D 2571/00864; B65D 2571/00987; B65D 2577/205; B65D 2581/3466; B65D 35/46; B65D 35/565; B65D 37/00; B65D 39/00; B65D 39/0011; B65D 41/04; B65D 41/0414; B65D 41/0421; B65D 41/0428; B65D 41/0435; B65D 41/0471; B65D 41/0492; B65D 41/08; B65D 41/3404; B65D 41/3409; B65D 41/3423; B65D 41/3442; B65D 41/348; B65D 41/46; B65D 41/48; B65D 3/00; B65D 43/021; B65D 43/0229; B65D 43/0231; B65D 43/0283; B65D 43/162; B65D 43/163; B65D 45/305; B65D 47/06; B65D 47/061; B65D 47/063; B65D 47/0804; B65D 47/0842; B65D 47/0847; B65D 47/0861; B65D 47/088; B65D 47/103; B65D 47/106; B65D 47/2031; B65D 47/2037; B65D 47/2075; B65D 47/242; B65D 47/243; B65D 47/247; B65D 47/263; B65D 47/265; B65D 47/32; B65D 47/36; B65D 49/02; B65D 5/02; B65D 5/3621; B65D 5/42; B65D 5/4208; B65D 5/4212; B65D 5/4266; B65D 5/4291; B65D 5/46032; B65D 5/4608; B65D 5/46088; B65D 5/4802; B65D 5/48048; B65D 5/5253; B65D 5/5405; B65D 5/541; B65D 5/5415; B65D 5/542; B65D 5/5445; B65D 5/5495; B65D 5/563; B65D 5/603; B65D 5/606; B65D 5/72; B65D 5/724; B65D 5/726; B65D 5/746; B65D 51/16; B65D 51/1616; B65D 51/1622; B65D 51/1633; B65D 51/1638; B65D 51/1644; B65D 51/1672; B65D 51/1688; B65D 51/20; B65D 51/24; B65D 51/242; B65D 51/245; B65D 51/248; B65D 51/28; B65D 51/2814; B65D 51/2835; B65D 51/2864; B65D 51/30; B65D 55/02; B65D 55/028; B65D 65/40; B65D 65/46; B65D 65/466; B65D 71/004; B65D 71/0096; B65D 71/02; B65D 71/08; B65D 71/10; B65D 71/125; B65D 71/36; B65D 71/50; B65D 71/506; B65D 71/70; B65D 75/008; B65D 75/12;

B65D 75/56; B65D 75/566; B65D 75/58; B65D 75/5877; B65D 75/5883; B65D 77/00; B65D 77/06; B65D 77/062; B65D 77/065; B65D 77/067; B65D 77/22; B65D 77/225; B65D 77/24; B65D 77/283; B65D 77/30; B65D 79/005; B65D 79/0084; B65D 79/0087; B65D 81/18; B65D 81/20; B65D 81/2015; B65D 81/2053; B65D 81/2076; B65D 81/24; B65D 81/26; B65D 81/261; B65D 81/263; B65D 81/266; B65D 81/28; B65D 81/30; B65D 81/32; B65D 81/3205; B65D 81/3216; B65D 81/3233; B65D 81/3261; B65D 81/3266; B65D 81/3286; B65D 81/3484; B65D 81/36; B65D 81/361; B65D 81/3806; B65D 81/3811; B65D 81/3837; B65D 81/3869; B65D 83/00; B65D 83/0055; B65D 83/0077; B65D 83/0409; B65D 83/0823; B65D 83/14; B65D 83/20; B65D 83/32; B65D 83/44; B65D 83/62; B65D 83/70; B65D 85/305; B65D 85/72; B65D 85/73; B65D 85/804; B65D 85/8043; B65D 85/8046; B65D 85/8052; B65D 85/8055; B65D 85/8058; B65D 85/8061; B65D 85/8067; B65D 85/808; B65D 85/8085; B65D 85/812; B65D 1/00; B65D 1/04; B65D 1/10; B65D 1/22; B65D 1/26; B65D 1/28; B65D 1/30; B65D 1/32; B65D 1/323; B65D 1/34; B65D 1/36; B65D 11/10; B65D 11/22; B65D 15/06; B65D 15/14; B65D 15/24; B65D 17/00; B65D 17/08; B65D 17/12; B65D 17/34; B65D 17/4011; B65D 17/402; B65D 17/462; B65D 17/506; B65D 19/0073; B65D 21/02; B65D 21/0206; B65D 21/0209; B65D 21/0219; B65D 21/022; B65D 21/0222; B65D 21/0226; B65D 21/0224; B65D 21/0234; B65D 21/0237; B65D 21/062; B65D 21/064; B65D 21/066; B65D 21/08; B65D 21/086; B65D 2203/12; B65D 2205/025; B65D 2207/00; B65D 2209/00; B65D 2231/025; B65D 2251/0015; B65D 2251/0028; B65D 2251/0031; B65D 2251/0081; B65D 2251/009; B65D 2251/0093; B65D 2251/08; B65D 2251/09; B65D 2251/1008; B65D 2251/1016; B65D 2251/1025; B65D 2251/205; B65D 2301/20; B65D 2313/00; B65D 2401/05; B65D 2401/15; B65D 25/08; B65D 25/10; B65D 25/16; B65D 25/18; B65D 25/20; B65D 25/205; B65D 25/24; B65D 25/28; B65D 25/2888; B65D 25/34; B65D 25/36; B65D 25/42; B65D 25/54; B65D 25/56; B65D 2517/0013; B65D 2519/00079; B65D 2519/00114; B65D 2519/00129; B65D 2519/0288; B65D 2519/00293; B65D 2525/283; B65D 2543/00009; B65D 2543/00027; B65D 2543/00046; B65D 2543/00064; B65D 2543/00074; B65D 2543/00083; B65D 2543/00101; B65D 2543/00111; B65D 2543/0012; B65D 2543/00138; B65D 2543/00175; B65D 2543/00194; B65D 2543/00203; B65D 2543/0024; B65D 2543/00268; B65D 2543/00305; B65D 2543/00361; B65D 2543/0037; B65D 2543/00398; B65D 2543/00407; B65D 2543/00416; B65D 2543/00425; B65D 2543/00435; B65D 2543/00462; B65D 2543/00481; B65D 2543/005; B65D 2543/00527; B65D 2543/00574; B65D 2543/00611; B65D 47/38; B65D 5/00; B65D 5/0005; B65D 5/0015; B65D 5/0209; B65D 5/0254; B65D 5/029; B65D 5/04; B65D 5/06; B65D 5/065; B65D 5/067; B65D 5/068; B65D 5/18; B65D 5/20; B65D 5/2023; B65D 5/2028; B65D 5/2033; B65D 5/2038; B65D 5/2047; B65D 5/2057; B65D 5/209; B65D 5/241; B65D 5/244; B65D 5/248; B65D 5/28; B65D 5/302; B65D 5/32; B65D 5/324; B65D 5/3685; B65D 5/40; B65D 5/4204; B65D 5/4216; B65D 5/4279; B65D 5/4295; B65D 5/445; B65D 5/46; B65D 5/46072; B65D 5/48002; B65D 5/48022; B65D 5/48024; B65D 5/48042; B65D 5/5002; B65D 5/5007; B65D 5/5033; B65D 5/5038; B65D 5/5069; B65D 5/52; B65D 5/54; B65D 5/5425; B65D 5/5435; B65D 5/5455; B65D 5/546; B65D 5/56; B65D 5/566; B65D 5/62; B65D 5/64; B65D 5/66; B65D 5/6664; B65D 5/667; B65D 5/6697; B65D 5/68; B65D 5/70; B65D 5/708; B65D 5/747; B65D 50/046; B65D 51/145; B65D 51/1605; B65D 51/1611; B65D 51/18; B65D 51/1627; B65D 5/1633; B65D 51/165; B65D 51/1683; B65D 51/1694; B65D 51/185; B65D 51/223; B65D 51/224; B65D 51/225; B65D 51/226; B65D 51/243; B65D 51/244; B65D 51/246; B65D 51/247; B65D 51/2807; B65D 51/2821; B65D 51/2828; B65D 51/2842; B65D 51/864; B65D 51/2878; B65D 51/32; B65D 53/00; B65D 53/02; B65D 53/04; B65D 53/06; B65D 53/08; B65D 55/066; B65D 55/08; B65D 55/0818; B65D 55/0863; B65D 55/14; B65D 55/145; B65D 55/16; B65D 63/1027; B65D 65/00; B65D 65/02; B65D 65/10; B65D 65/14; B65D 65/20; B65D 65/22; B65D 65/38; B65D 65/403; B65D 65/42; B65D 65/463; B65D 7/04; B65D 7/045; B65D 7/08; B65D 7/26; B65D 71/0088; B65D 71/502; B65D 73/0028; B65D 73/0078; B65D 75/00; B65D 75/002; B65D 75/006; B65D 75/04; B65D 75/08; B65D 75/20; B65D 75/225; B65D 75/26; B65D 75/28; B65D 75/30; B65D 75/305; B65D 75/32; B65D 75/321; B65D 75/322; B65D 75/323; B65D 75/325; B65D 75/326; B65D 75/327; B65D 75/36; B65D 75/366; B65D 75/367; B65D 75/368; B65D 75/38; B65D 75/42; B65D 75/48; B65D 75/52; B65D 75/522; B65D 75/525; B65D 75/527; B65D 75/54; B65D 75/545; B65D 75/563; B65D

75/5805; B65D 75/5811; B65D 75/5816; B65D 75/5827; B65D 2543/00638; B65D 2543/00648; B65D 2543/0657; B65D 2543/00703; B65D 2543/00731; B65D 2543/00814; B65D 2543/00842; B65D 2543/0087; B65D 2543/00879; B65D 2543/00888; B65D 2543/00898; B65D 2543/00907; B65D 2543/00953; B65D 2543/00972; B65D 2543/00981; B65D 2543/0099; B65D 2547/066; B65D 2563/101; B65D 2565/385; B65D 2565/387; B65D 2565/388; B65D 2571/00066; B65D 2575/586; B65D 2577/045; B65D 2577/2025; B65D 2577/2033; B65D 2577/2066; B65D 2571/2091; B65D 2581/053; B65D 2581/055; B65D 2581/34; B65D 2581/3402; B65D 2581/3404; B65D 2581/3405; B65D 2581/3406; B65D 2581/3408; B65D 2581/3409; B65D 2581/341; B65D 2581/3412; B65D 3581/3413; B65D 2581/3416; B65D 2581/3417; B65D 2581/3418; B65D 2581/3421; B65D 2581/3422; B65D 2581/3424; B65D 2581/3425; B65D 2581/3427; B65D 2581/3428; B65D 2581/3429; B65D 2581/3431; B65D 2581/3432; B65D 2581/3433; B65D 2581/3435; B65D 2581/3436; B65D 2581/3437; B65D 2581/3439; B65D 2581/344; B65D 2581/3441; B65D 3581/3443; B65D 2581/3444; B65D 2581/3445; B65D 2581/3447; B65D 2581/3448; B65D 2581/345; B65D 2581/3452; B65D 2581/3454; B65D 2581/3455; B65D 2581/3458; B65D 2581/346; B65D 2581/3462; B65D 2581/3464; B65D 2581/3467; B65D 2581/3468; B65D 2581/347; B65D 2581/3471; B65D 2581/3472; B65D 2581/3474; B65D 2581/3475; B65D 2581/3477; B65D 2581/3478; B65D 2581/3479; B65D 2581/3481; B65D 2581/3482; B65D 2581/3483; B65D 2581/3485; B65D 2581/3487; B65D 2581/3489; B65D 2581/349; B65D 2581/3491; B65D 2581/3493; B65D 2581/3494; B65D 2581/3495; B65D 2581/3497; B65D 2581/3498; B65D 2585/366; B65D 2585/6737; B65D 2590/0066; B65D 2590/046; B65D 29/02; B65D 3/02; B65D 3/04; B65D 3/06; B65D 3/10; B65D 3/14; B65D 3/22; B65D 3/26; B65D 3/263; B65D 3/28; B65D 31/00; B65D 31/02; B65D 31/06; B65D 31/10; B65D 31/12; B65D 31/147; B65D 31/16; B65D 33/00; B65D 33/001; B65D 33/002; B65D 33/004; B65D 33/01; B65D 33/02; B65D 33/04; B65D 33/06; B65D 33/14; B65D 33/16; B65D 33/1616; B65D 33/1625; B65D 33/20; B65D 33/25; B65D 33/2508; B65D 33/2525; B65D 33/2541; B65D 33/2566; B65D 35/04; B65D 35/08; B65D 35/10; B65D 35/14; B65D 35/28; B65D 35/30; B65D 35/38; B65D 35/56; B65D 41/0442; B65D 41/16; B65D 41/185; B65D 41/22; B65D 41/24; B65D 41/3428; B65D 41/47; B65D 43/00; B65D 43/02; B65D 43/0202; B65D 43/0204; B65D 43/0206; B65D 43/0208; B65D 43/0214; B65D 43/0216; B65D 43/0218; B65D 43/0222; B65D 43/0233; B65D 43/0256; B65D 43/06; B65D 43/16; B65D 43/169; B65D 45/16; B65D 45/18; B65D 45/20; B65D 47/04; B65D 47/066; B65D 47/08; B65D 47/0809; B65D 47/0814; B65D 47/0838; B65D 5/064; B65D 51/1661; B65D 51/1666; B65D 75/5833; B65D 75/5844; B65D 75/5855; B65D 75/5866; B65D 75/5872; B65D 75/5888; B65D 75/5894; B65D 77/003; B65D 77/02; B65D 77/04; B65D 77/0406; B65D 77/0413; B65D 77/042; B65D 77/0433; B65D 77/044; B65D 77/064; B65D 77/20; B65D 77/2008; B65D 77/2012; B65D 77/2016; B65D 77/2024; B65D 77/2028; B65D 77/2032; B65D 77/2036; B65D 77/204; B65D 77/2044; B65D 77/2052; B65D 77/2056; B65D 77/206; B65D 77/2064; B65D 77/208; B65D 77/2088; B65D 77/245; B65D 77/286; B65D 77/38; B65D 79/02; B65D 81/00; B65D 81/022; B65D 81/03; B65D 81/052; B65D 81/055; B65D 81/057; B65D 81/058; B65D 81/2023; B65D 81/203; B65D 81/2038; B65D 81/2061; B65D 81/2069; B65D 81/2084; B65D 81/2092; B65D 81/245; B65D 81/262; B65D 81/264; B65D 81/267; B65D 81/268; B65D 81/3222; B65D 81/3238; B65D 81/3272; B65D 81/3283; B65D 81/3294; B65D 81/34; B65D 81/3407; B65D 81/3415; B65D 81/3423; B65D 81/343; B65D 81/3446; B65D 81/3453; B65D 81/3461; B65D 81/3469; B65D 81/3476; B65D 81/38; B65D 81/3818; B65D 81/3823; B65D 81/3825; B65D 81/3841; B65D 81/3846; B65D 81/3848; B65D 81/3853; B65D 81/3858; B65D 81/386; B65D 81/3865; B65D 81/3874; B65D 81/3876; B65D 81/3881; B65D 81/3886; B65D 81/3893; B65D 81/3897; B65D 83/0011; B65D 83/0022; B65D 83/0072; B65D 83/0094; B65D 83/06; B65D 83/0805; B65D 83/0841; B65D 83/38; B65D 83/40; B65D 83/48; B65D 83/72; B65D 83/752; B65D 85/00; B65D 85/07; B65D 85/34; B65D 85/36; B65D 85/50; B65D 85/60; B65D 85/70; B65D 85/78; B65D 85/8049; B65D 85/8064; B65D 85/816; B65D 88/121; B65D 88/128; B65D 88/528; B65D 88/54; B65D 88/74; B65D 88/745; B65D 88/76; B65D 9/06; B65D 9/34; B65D 90/00; B65D 90/0033; B65D 90/0073; B65D 90/008; B65D 90/0086; B65D 90/046; B65D 90/06; B65D 90/08; B65D 75/5838; B65D 75/585; B65D 75/586; B65D 77/2096; B65D 79/0081; B65D

81/025; B65D 81/027; B65D 81/05; B65D 81/051; B65D 51/2023; B65D 81/22; B65D 81/265; B65D 81/325; B65D 81/3438; B65D 81/3816; B65D 81/382; B65D 81/3834; B65D 81/3862; B65D 81/3895; B65D 83/04; B65D 83/0463; B65D 83/206; B65D 83/384; B65D 83/388; B65D 83/42; B65D 83/425; B65D 83/52; B65D 83/60; B65D 83/68; B65D 83/682; B65D 83/75; B65D 83/76; B65D 83/768; B65D 73/771; B65D 83/7711; B65D 85/1045; B65D 85/10568; B65D 85/505; B65D 85/672; B65D 88/14; B65D 90/021; B65D 90/022; B65D 90/22

USPC ..... 53/79, 86, 105, 127, 128.1, 169, 266.1, 53/274, 284.7, 287, 403, 405, 410, 412, 53/416, 420, 425, 428, 432, 433, 434, 53/440, 450, 453, 455, 456, 459, 467, 53/469, 471, 476, 477, 478, 479, 510, 53/511, 571; 206/0.84, 45.23, 45.24, 206/45.25, 45.3, 204, 205, 208, 209, 210, 206/213.1, 216, 217, 219, 221, 222, 228, 206/229, 245, 256, 264, 278, 286, 287, 206/288, 315.9, 335, 349, 361, 365, 370, 206/386, 425, 427, 438, 439, 457, 459.1, 206/459.5, 462, 463, 467, 468, 469, 471, 206/484, 484.1, 484.2, 486, 497, 499, 206/503, 505, 508, 515, 516, 518, 519, 206/522, 524.1, 524.2, 524.3, 524.4, 206/524.6, 524.7, 524.8, 525, 526, 527, 206/530, 531, 532, 534, 538, 539, 541, 206/545, 550, 551, 557, 560, 561, 564, 206/568, 570, 572, 772, 776, 782, 807, 206/823, 824, 84, 0.5, 0.6, 0.7, 1.5, 1.9, 206/223, 225, 232, 233, 305, 461, 466, 206/81, 812, 813, 818, 820, 830; 215/6, 215/10, 12.2, 40, 42, 43, 44, 45, 204, 215/217, 219, 220, 227, 228, 230, 232, 215/233, 234, 235, 237, 239, 247, 248, 215/249, 250, 251, 252, 253, 254, 255, 215/256, 257, 258, 260, 261, 262, 266, 215/270, 271, 276, 277, 295, 298, 305, 215/306, 307, 308, 310, 311, 316, 318, 215/319, 320, 329, 332, 341, 342, 347, 215/348, 349, 350, 351, 354, 355, 384, 215/387, 388, 391, 902; 220/4.21, 4.23, 220/4.26, 4.27, 8, 23.4, 23.8, 23.83, 220/23.87, 62.11, 62.13, 62.18, 62.21, 220/62.22, 89.1, 89.2, 89.3, 200, 202, 220/203.01, 203.02, 203.03, 203.04, 220/203.08, 203.1, 203.11, 203.12, 220/203.15, 203.16, 203.17, 203.18, 220/203.19, 203.27, 203.29, 212, 214, 220/226, 231, 245, 254.1, 256.1, 257.1, 220/257.2, 258.2, 258.3, 258.5, 259.1, 220/259.3, 260, 265, 266, 268, 269, 270, 220/271, 276, 277, 287, 296, 309.1, 324, 220/345.1, 345.2, 351, 359.1, 359.2, 220/359.3, 359.4, 360, 361, 362, 363, 220/364, 366.1, 367.1, 371, 372, 373, 220/374, 375, 483, 495.01, 495.03, 501, 220/507, 522, 523, 524, 555, 573.1, 574, 220/581, 592.2, 601, 604, 608, 609, 619, 220/620, 626, 628, 655, 657, 658, 660, 220/666, 669, 675, 676, 697, 703, 709, 220/710, 713, 745, 780, 785, 787, 796, 220/833, 847, 913, DIG. 1, DIG. 27, 272, 220/377, 4.12, 495.04, 495.06, 495.08, 220/505, 560.04, 560.08, 560.12, 560.14, 220/560.15, 562, 564, 586, 592.25, 220/592.26, 592.27, 62.12, 62.15, 62.17, 220/62.2, 711, 721, 723, 737, 782, 784, 220/810, 838, 901, 902, 920; 229/4.5, 229/5.5, 5.6, 5.7, 5.82, 5.83, 5.84, 5.85, 229/80.5, 87.05, 87.08, 87.09, 93, 101.1, 229/101.2, 102, 103.1, 104, 106, 107, 229/120, 120.01, 120.02, 120.03, 120.05, 229/120.07, 120.09, 120.35, 123.1, 123.2, 229/123.3, 125.01, 125.03, 125.05, 229/125.06, 125.07, 125.08, 125.12, 229/125.13, 125.14, 125.15, 125.17, 229/125.19, 125.25, 125.26, 125.29, 229/125.33, 125.35, 125.36, 126, 160.2, 229/162.1, 162.3, 164.1, 169, 185.1, 229/198.2, 198.3, 200, 201, 205, 207, 229/208, 209, 211, 227, 232, 237, 242, 229/245, 247, 400, 401, 404, 406, 407, 229/902, 903, 924, 925, 927; 383/5, 42, 383/80, 94, 96, 103, 104, 106, 111, 116, 383/119, 200, 203, 204, 207, 210, 211; 493/128, 157, 195, 210, 213, 216, 222, 493/223, 224, 228, 267, 339

See application file for complete search history.

(56) References Cited

U.S. PATENT DOCUMENTS

| | | | | |
|---|---|---|---|---|
| 5,039,001 | A | 8/1991 | Kinigakis et al. | |
| 5,464,969 | A | 11/1995 | Miller | |
| 5,863,499 | A | 1/1999 | Kralovic | |
| 5,911,334 | A | 6/1999 | Helms | |
| 6,663,284 | B2 * | 12/2003 | Buckingham | F16K 15/144 220/203.15 |
| 7,789,262 | B2 | 9/2010 | Niederer et al. | |
| 8,720,729 | B2 * | 5/2014 | Madai | B65D 81/3453 383/103 |
| 9,352,893 | B2 | 5/2016 | Utz et al. | |
| 2010/0068352 | A1 | 3/2010 | Lonergan et al. | |
| 2010/0266732 | A1 | 10/2010 | Thomas et al. | |
| 2011/0056949 | A1 | 3/2011 | Reiterer et al. | |
| 2015/0102030 | A1 * | 4/2015 | Gardner | B65D 77/225 137/511 |
| 2016/0176613 | A1 * | 6/2016 | Tzu | B65D 51/1638 206/484.1 |
| 2017/0210503 | A1 | 7/2017 | de Cleir et al. | |
| 2017/0355509 | A1 * | 12/2017 | Tzu | B32B 27/36 |

FOREIGN PATENT DOCUMENTS

| | | | | | |
|---|---|---|---|---|---|
| EP | 0 967 160 | A1 | | 12/1999 | |
| EP | 1 935 805 | B1 | | 6/2008 | |
| EP | 1 122 189 | A1 | | 8/2021 | |
| FR | 2 949 447 | A1 | | 3/2011 | |
| GB | 2526548 | A | * | 12/2015 | B32B 27/08 |
| JP | 10258878 | A | * | 9/1998 | B65D 77/20 |
| JP | H10258878 | A | * | 9/1998 | B65D 77/20 |
| JP | 2001315863 | A | | 11/2001 | |
| JP | 2002037317 | A | * | 2/2002 | B65D 65/40 |
| JP | 2004042963 | A | | 2/2004 | |
| JP | 2005067642 | A | | 3/2005 | |
| JP | 2007320582 | A | * | 12/2007 | B65D 51/16 |
| JP | 2010076833 | A | | 4/2010 | |
| JP | 2012051633 | A | * | 3/2012 | B65D 83/00 |
| JP | WO2012073274 | A | * | 6/2012 | B65D 77/206 |
| JP | 2013043668 | A | | 3/2013 | |

(56) References Cited

FOREIGN PATENT DOCUMENTS

| | | | | | |
|---|---|---|---|---|---|
| JP | 2013209127 | A | * | 10/2013 | ..... B65D 81/34 |
| JP | 2013209128 | A | * | 10/2013 | ..... B65D 81/34 |
| JP | 2014024553 | A | * | 2/2014 | ..... B65D 81/34 |
| JP | 5926643 | B2 | * | 5/2016 | ..... B65D 81/34 |
| JP | 2018138467 | A | * | 9/2018 | ..... B65D 81/34 |
| KR | 101715327 | B1 | * | 3/2017 | ..... B65D 81/3415 |
| RU | 2 546 487 | C2 | | 4/2015 | |
| WO | 2007113930 | A1 | | 10/2007 | |
| WO | 2008130901 | A1 | | 10/2008 | |
| WO | WO-2012073274 | A1 | * | 6/2012 | ..... B65D 77/2032 |
| WO | WO-2018181616 | A1 | * | 10/2018 | ..... B32B 27/00 |

OTHER PUBLICATIONS

Article: Easy Open Film for Boil and Retort Difaren E3700T, E3800T—Google Translate (Year: 201), Author: DIC Corporation, URL: pp. 77-78, URL: https://www.dic-global.com/pdf/r_and_d/review/dic_r_and_d_2001.pdf, URL Last Check: Apr. 2, 2024, Language: English (via Google Translate).*

International Search Report and Written Opinion for PCT/US2021/027475, dated Aug. 4, 2021 (9 pp.).

Hot lid venting concept, Technology Vitality Report, ip.com, dated Mar. 3, 2020 (10 pp.).

Extended Search Report for EP 21789565.5, dated Mar. 14, 2024 (9 pp.).

* cited by examiner

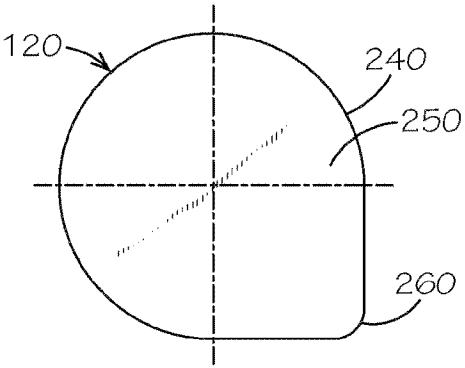
FIG. 3
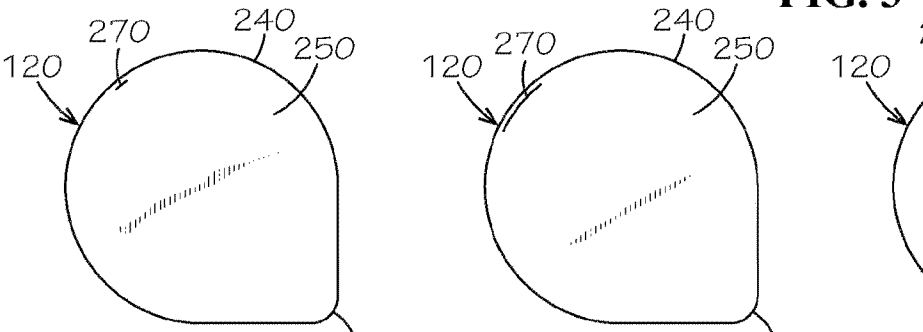
FIG. 4A
FIG. 4B
FIG. 4C
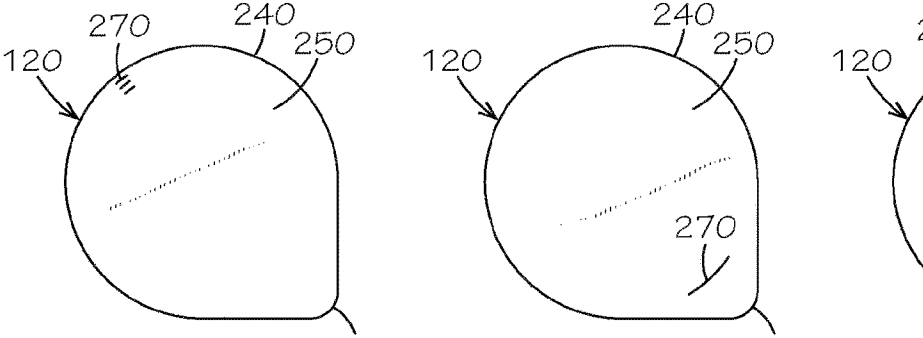
FIG. 4D
FIG. 4E
FIG. 4F
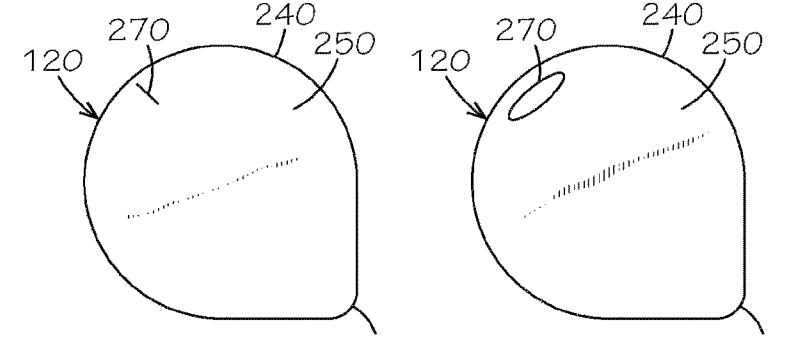
FIG. 4G

VENTABLE PACKAGE FOR FOOD AND BEVERAGES

TECHNICAL FIELD

The present application and the resultant patent relate generally to food and beverage containers and the like and more particularly relate to a ventable package for food and beverages having a hermetically sealed lid capable of self-venting under the application of heat and/or internal pressure.

BACKGROUND OF THE INVENTION

Cups and other containers may be filled with food or beverages and sealed for shipment to a consumer. The container may be made of plastic, paper, glass, or other types of suitable materials with a hermetically sealed lid such as a foil or plastic membrane. The contents of the container thus may be protected from environmental ingress and/or contamination. Depending on the filling conditions and the barrier properties of the container, the contents may have a long shelf-life.

If aseptically filled, a beverage may be safely distributed at ambient temperatures because the beverage remains sealed from the external environment. If, however, the product is heated at the point of use by microwave energy, induction, conduction, or another heating method, the contents and headspace within the container may become hot and may expand. This expansion may cause an uncontrolled release of the pressure by bursting the membrane or the membrane seal or another weak point in the container. This can result in a sudden release of the pressure and/or other undesirable consequences. Moreover, the pressure may exacerbated the distortion of the container sidewalls, base, and/or top and may result in rocker bottoms, bulging appearances, and may cause the container to tip over and spill the contents therein. Due to the resultant large opening, the contents of the container may now easily spill while carrying the container.

SUMMARY OF THE INVENTION

The present application and the resultant patent provide a ventable package capable of releasing pressure upon the application of heat. The ventable package may include a container and a lid. The lid may include a sealing layer attached to the container and a foil layer attached to the sealing layer. The sealing layer may include one or more slits therein such that, upon the application of heat, the foil layer separates from the sealing layer about the one or more slits to release the pressure therein.

The present application and the resulting patent further provide a ventable package for food and beverages capable of releasing pressure upon the application of heat or internal pressure. The ventable package may include a plastic container and a lid. The plastic container may include a ledge. The lid may include a plastic sealing layer attached to the ledge of the plastic container and an aluminum foil layer attached to the plastic sealing layer. The plastic sealing layer may include one or more slits therein such that, upon the application of heat or internal pressure, the aluminum foil layer separates from the plastic sealing layer about the one or more slits to release the pressure therein.

These and other features and improvements of the present application and the resultant patent will become apparent to one of ordinary skill in the art upon review of the following detailed description when taken in conjunction with the shown drawings and the appended claims.

BRIEF DESCRIPTION OF THE DRAWINGS

FIG. 3 is a plan view of the lid of the ventable package of FIG. 1.

FIG. 4A is a plan view of an alternative embodiment of a lid for use with the ventable package of FIG. 1.

FIG. 4B is a plan view of an alternative embodiment of a lid for use with the ventable package of FIG. 1.

FIG. 4C is a plan view of an alternative embodiment of a lid for use with the ventable package of FIG. 1.

FIG. 4D is a plan view of an alternative embodiment of a lid for use with the ventable package of FIG. 1.

FIG. 4E is a plan view of an alternative embodiment of a lid for use with the ventable package of FIG. 1.

FIG. 4F is a plan view of an alternative embodiment of a lid for use with the ventable package of FIG. 1.

FIG. 4G is a plan view of an alternative embodiment of a lid for use with the ventable package of FIG. 1.

DETAILED DESCRIPTION

Figure 1:
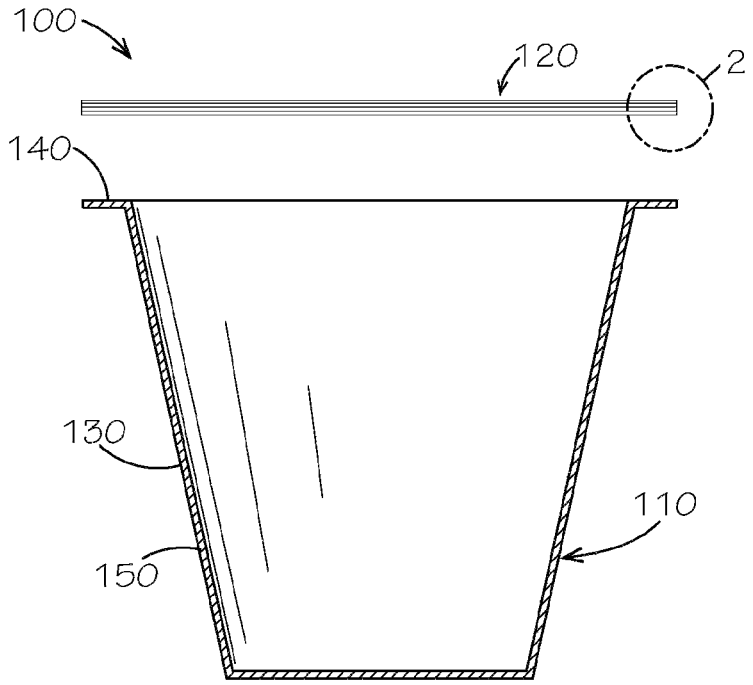
FIG. 1 is a plan view of an example of a ventable package with a container and a lid as may be described herein.

Referring now to the drawings, in which like numerals refer to like elements throughout the several views, FIG. 1 shows a ventable package 100 as may be described herein. The ventable package 100 may include a container 110 and a lid 120. The container 110 may have any suitable size, shape, or configuration. The container 110 may be a cup, a tray, a bowl, a bottle, and the like. The container 110 may be made from paperboard, glass, plastic, foam, or any type of rigid or semi-rigid materials. Examples include, but are not limited to, materials such as polyolefins, polyesters, vinyls, acrylics, styrenics, blends, or other plastics materials, foams, or composites. The material may be food grade as appropriate. The container 110 may be manufactured by injection molding, thermoforming, blow molding, or any other method to produce the container 110 in three dimensions. In the example of FIG. 1, the container 110 includes a body 130 and a ledge 140. Although the body 130 has a frustoconical shape 150, any shape or size may be used. The ledge 140 extends beyond the sidewalls of the body 130 (although an inward ledge is also possible). Other components and other configurations may be used herein.

Figure 2:
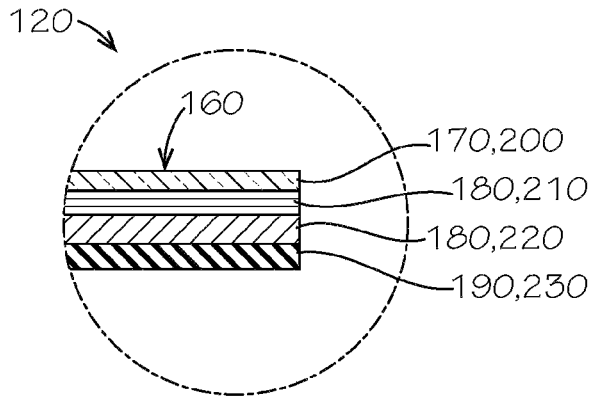
FIG. 2 is a side cross-sectional view of the lid of the ventable package of FIG. 1.

The lid 120 also may have any suitable size, shape, or configuration. The shape of the lid 120 may conform generally to the shape of the container 110 and more specifically to the shape of the ledge 140. FIG. 2 shows an enlarged cross-sectional view of an example of the lid 120. In this example, the lid 120 may have multiple layers 160: a top layer 170, one or more middle layers 180, and a bottom layer 190. Any number of other layers 160 may be used herein.

The top layer 170 may be a plastic overlacquer 200 or other types of overlayers. For example, the plastic overlacquer 200 may be acrylate-based or a polymer lamination and the like. One of the middle layers 180 may be a paper layer 210. The paper layer 210 may be printed with product indicia, graphics, and the like. A further middle layer 180 may be an aluminum foil layer 220 and the like. The aluminum foil layer 220 may be a soft aluminum alloy and the like. The bottom layer 190 may be a plastic sealant layer 230. The plastic sealant layer 230 may include polyolefin, acrylate, and the like. The plastic sealant layer 230 may be adhered to the aluminum foil layer 220 in a strong but breakable bond. Likewise, the plastic sealant layer 230 forms a permanent, un-separable bond with the container 110, i.e., about the ledge 140 of the container 110. The plastic sealant layer 230 may be sealed to the container 110 via heat, pressure, ultrasonics, and other sealing technics. As is shown in FIG. 3, the lid 120 may have a periphery 240 and a middle portion 250. When appropriate, the periphery 240 may include a pull tab section 260.

The plastic sealing layer 230 may have one or more slits 270 formed therein. The slits 270 may extend through the width of the plastic sealing layer 230 to the aluminum foil layer 220. The slits 270 may be formed via laser scoring and similar techniques. Additionally, the slits 270 may be formed separately in the sealant layer, and such layer may then be laminated to the other layers of the lid 120 (the other layer next to the sealing layer may be aluminum or any number of other suitable materials). Any number of the slits 270 may be used in any suitable size, shape, or configuration. The slits 270 may be formed in the middle portion 250 of the plastic sealing layer 230 close to the periphery 240. Specifically, the slits 270 may be about 1 to about 40 millimeters in length and may be positioned from about 0 to about 5 millimeters from the seal inner edge (i.e., the inside edge of the ledge 140) or about 2 to about 7 millimeters from the exterior edge or the periphery 240. The size and shape of the slits 270 may vary according to the size and shape of the lid 120 and the container 110. The slits 270 may be positioned such that they compensate for tolerance variations that may occur in the placement of lid 120 onto the container 110 caused by variations in the conveyor plates, lid placement, and/or sealing heads so as to ensure that at least one of the slits 270 will function as desired if the others are sealed over or are otherwise mispositioned.

FIGS. 4A-4G show different exemplary orientations of the slits 270 in the plastic sealing layer 230. FIG. 4A shows a single slit 270 of short length positioned parallel to the periphery 240. Note that the slit 270 does not extend to the periphery 240. FIG. 4B shows a single slit 270 of longer length and slightly curved positioned parallel to the periphery 240. FIG. 4C shows a number of long, straight slits 270 positioned perpendicularly to the periphery 240. FIG. 4D shows a number of short slits 270 of variable length and with a slight curve positioned parallel to the periphery 240. FIG. 4E shows a single slit 270 of longer length and slightly curved positioned parallel to the pull tab 260. FIG. 4F shows a single slit 270 of short length and slightly curved positioned perpendicularly to the periphery 240. FIG. 4G shows a slit 270 (or a number of slits 270) in the shape of an oval positioned parallel to the periphery 240. Many different sizes, shapes, and configurations may be used.

Figure 5:
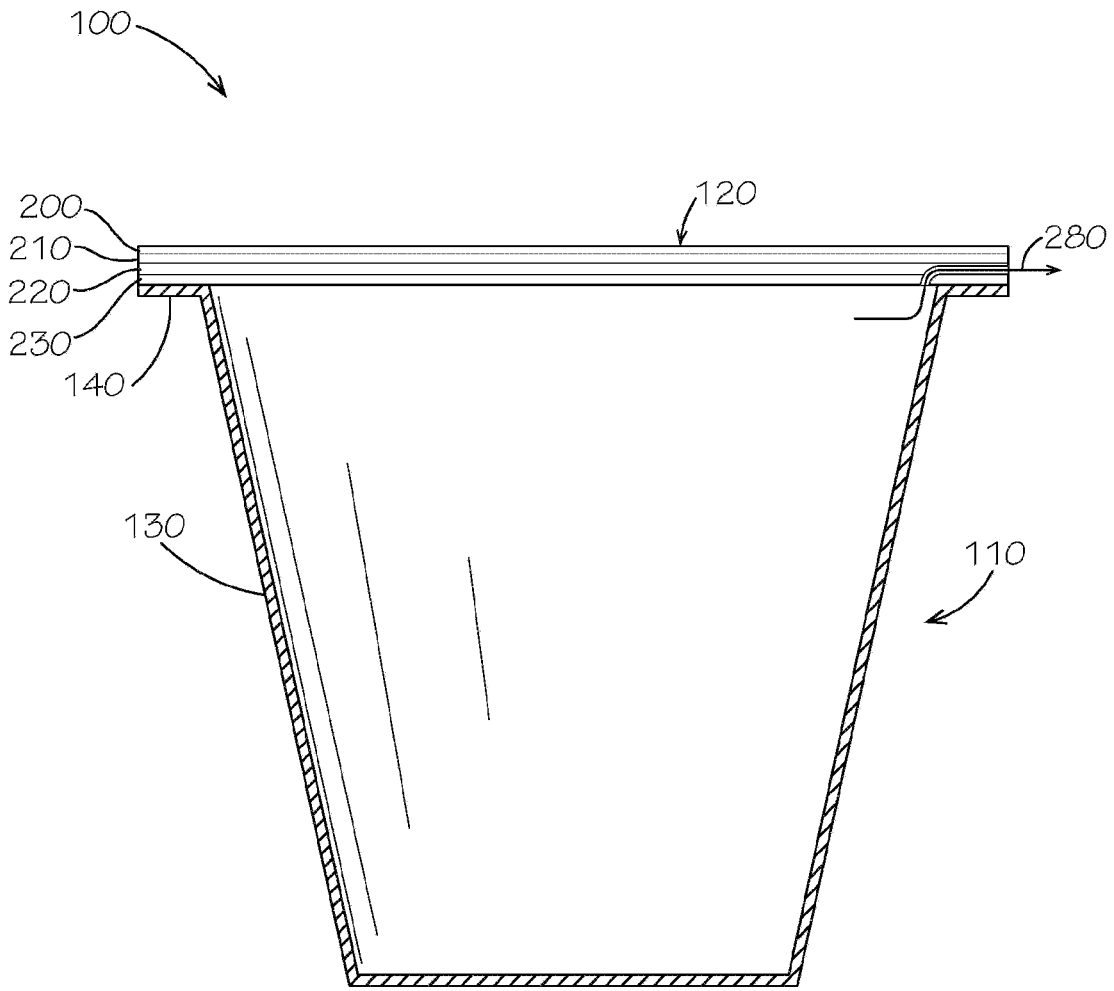
FIG. 5 is a side cross-sectional view of the ventable package as vented via an air escape route.

In use, food, beverages, or other items may be placed in the container 110. The lid 120 with the slits 270 thereon may be attached to the container 110 to hermetically seal and form the ventable package 100. At this point the slits 270 extend proximal to the edge of the ledge 140 of the container 110 but do not provide a pathway for air exchange between the container 110 and the environment. When the ventable package 100 is heated, increased gas pressure develops therein. (Heat alone is not sufficient.) When sufficient pressure is developed, tensile forces will act upon the lid 120 causing the plastic sealing layer 230 to separate from the aluminum layer 220 thus causing the gas to flow into an exit path(s) 280 created by the slits 270, thus permitting the gas to escape therethrough. As is shown in FIG. 5, the slits 270 in the plastic sealant layer 230 are positioned in locations just close enough to the periphery 240 of the lid 120 and in the preferred orientations and dimensions to permit the plastic sealant layer 230 to locally disengage from the aluminum foil layer 220 so as to create the exit path 280 under the aluminum foil layer 220 for the heated gases to escape the ventable package 100 and therefore relieve some of the excess pressure build up therein.

The ventable package 100 thus may safely and controllably relieve the internal pressure (gas/water vapor) therein while maintaining other desirable functions such as a reduced or no propensity to spill the contents such that consumers can easily walk or transport the ventable package 100. This feature is also very useful to ensure venting of the ventable package 100 if it is accidentally or intentionally overheated. This feature also ensures that the ventable package 110 always maintains, prior to opening, a hermetic seal against the environment prior to use and as such assists with providing prolonged product protection for sterility and long shelf-life.

Moreover, the ventable package 100 does not use additional materials, components, or weight for more affordable packaging materials costs, i.e., the ventable package 100 does not need to be extremely rigid to withstand and resist the pressures that are generated during heating. Instead, the pressure relieves out of the ventable package 100 at higher pressures thus allowing the use of thinner walls that, without the exit path 280, would otherwise be likely to deform. The ventable package 100 thus does not require conforming walls, panels, or other features that accommodate the expansion caused by pressure build-up therein. The ventable package 100 provides a simpler, less complex, and lighter container design because conforming walls, stiffing features, or thicker profiles are not required.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A ventable package capable of releasing pressure upon the application of heat in a microwave, comprising:
- a container; and
- a lid;
- the lid comprising a sealing layer attached to the container and a metallic foil layer directly attached to the sealing layer;
- the sealing layer comprising one or more slits therein;
- wherein, upon the application of heat, the metallic foil layer separates from the sealing layer about the one or more slits to release the pressure therein.

2. The ventable package of claim 1, wherein the container is from the group consisting of plastic or paper.

3. The ventable package of claim 1, wherein the container comprises a ledge wherein the lid is sealed to the container about the ledge.

4. The ventable package of claim 3, wherein the one or more slits of the sealing layer are positioned about an inside edge of the ledge.

5. The ventable package of claim 1, wherein sealing layer comprises a plastic.

6. The ventable package of claim 1, wherein the metallic foil layer comprises an aluminum foil.

7. The ventable package of claim 1, wherein the lid comprises a paper layer over the metallic foil layer.

8. The ventable package of claim 7, wherein the lid comprises an over lacquer over the paper layer.

9. The ventable package of claim 1, wherein the lid comprises a periphery and a middle region neighboring the periphery and situated over an internal volume of the ventable package.

10. The ventable package of claim 9, wherein the one or more slits do not extend to the periphery.

11. The ventable package of claim 9, wherein the one or more slits are positioned in the middle region parallel to the periphery.

12. The ventable package of claim 9, wherein the one or more slits are positioned in the middle region perpendicularly to the periphery.

13. The ventable package of claim 1, wherein the one or more slits are from the group consisting of a straight shape, a curved shape, an oval shape, or a circular shape.

14. The ventable package of claim 1, wherein the lid comprises a pull tab and wherein the one or more slits are positioned adjacent to the pull tab.

15. A ventable package for food and beverages capable of releasing pressure upon the application of heat in a microwave, comprising:

a plastic container;

the plastic container comprising a ledge; and a lid;

the lid comprising a plastic sealing layer attached to the ledge of the plastic container and an aluminum foil layer directly attached to the plastic sealing layer;

the plastic sealing layer comprising one or more slits therein;

wherein, upon the application of heat or internal pressure, the aluminum foil layer separates from the plastic sealing layer about the one or more slits to release the pressure therein.

16. The ventable package of claim 15, wherein the one or more slits of the plastic sealing layer are positioned about an inside edge of the ledge.

17. The ventable package of claim 15, wherein the lid comprises a paper layer and an over lacquer over the aluminum foil layer.

18. The ventable package of claim 15, wherein the lid comprises a periphery and a middle region neighboring the periphery and situated over an internal volume of the ventable package and wherein the one or more slits do extend to the periphery.

19. The ventable package of claim 18, wherein the one or more slits are positioned in the middle region parallel or perpendicularly to the periphery.

20. The ventable package of claim 15, wherein the one or more slits are from the group consisting of a straight shape, a curved shape, an oval shape, or a circular shape.

* * * * *